United States Patent [19]

Prins

[11] Patent Number: 4,998,483

[45] Date of Patent: Mar. 12, 1991

[54] BOGIE STEERING SYSTEM

[75] Inventor: Petrus D. Prins, Safarituine, South Africa

[73] Assignee: Goldfieds Engineering (Proprietary) Limited, Odendaalsrus, South Africa

[21] Appl. No.: 331,373

[22] Filed: Mar. 31, 1989

[51] Int. Cl.[5] ..... B61D 17/00

[52] U.S. Cl. ..... 105/3; 104/7.3; 213/86

[58] Field of Search ..... 105/165, 3, 167, 176, 105/4.1, 168, 169, 170, 4.2, 200, 201; 280/442, 444; 213/78, 86, 87; 104/7.3

[56] References Cited

U.S. PATENT DOCUMENTS

| | | | |
|---|---|---|---|
| 655,229 | 8/1900 | Hawkins | 213/86 |
| 2,470,842 | 5/1949 | Barrington | 280/444 |
| 2,974,429 | 3/1961 | Stein | 104/7.3 |

*Primary Examiner*—Matthew C. Graham

*Attorney, Agent, or Firm*—Spencer & Frank

[57] ABSTRACT

A bogie unit including at least one wheeled axle pivotally movable about a central vertical axis, a drawbar pivotally secured to a pivot point, and a control device connected to the axle and engaged with the drawbar, the control device being movable, at least to a limited extent, relatively to the drawbar, and permitting pivotal movement of the axle, at least to a limited extent, relatively to the drawbar.

8 Claims, 13 Drawing Sheets

FIG. 10(B)
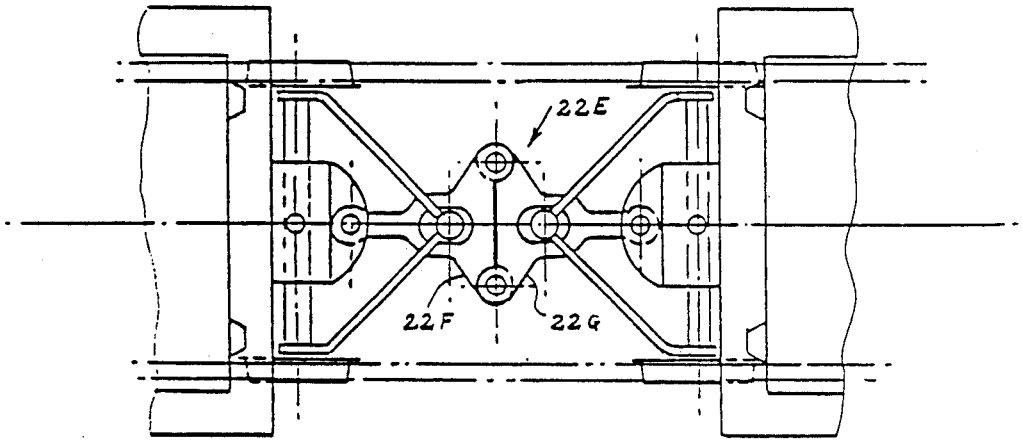
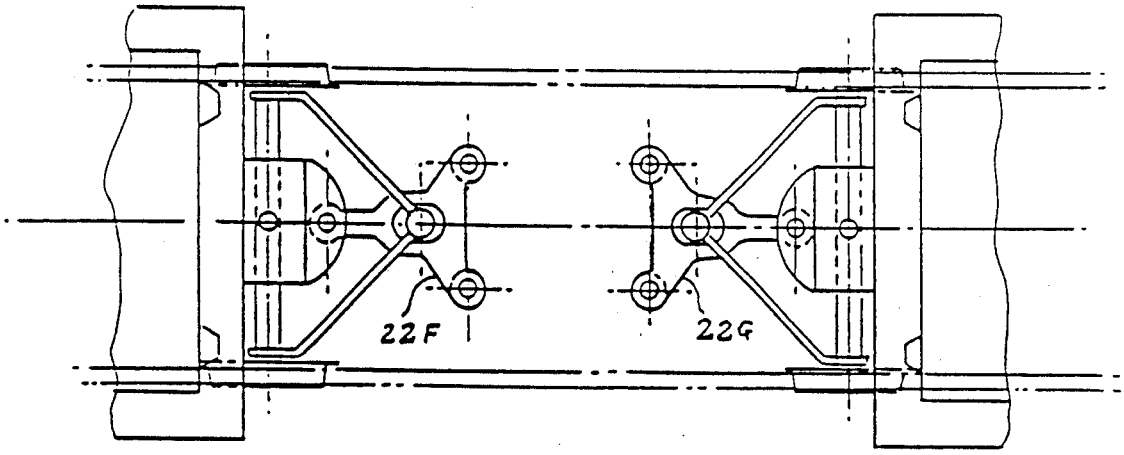
FIG. 10(A)

BOGIE STEERING SYSTEM

BACKGROUND OF THE INVENTION

This invention relates generally to a steering system for vehicles. The invention is particularly concerned with track vehicles but the scope of the specification is not to be confined to this particular application.

A four-wheeled bogie, or two single-axle bogies coupled together to form a "split bogie" system, requires at least one and a half times the guage width as the wheel base dimension to be properly guided by the rail tracks to prevent "jackknifing" of the bogie during operation. If this requirement is net and the bogie is run onto a sharply curved track, without means being provided for steering the axles relatively to each other, then the flanges of the wheels tend to bind to the inside surfaces of the rails as they are then geometrically incorrectly situated on the curved tracks. This results in a high rolling resistance and excessive wear of the wheels.

SUMMARY OF THE INVENTION

The invention provides a bogie unit which includes at least one wheeled axle which is pivotally movable about a central vertical axis, a drawbar which is pivotally secured to a pivot point, and control means connected to the axle and engaged with the drawbar, the control means being movable, at least to a limited extent, relatively to the drawbar, and permitting pivotal movement of the axle, at least to a limited extent, relatively to the drawbar.

The pivot point is preferably displaced from the central vertical axis.

The control means may include first and second control arms fixed to the axle on opposed sides of the central vertical axis.

The control means may be movable, relatively to the drawbar, in the direction in which the drawbar extends from the axle.

The drawbar may include a slot, groove or the like and the control means may include a formation which is slidably and pivotally engaged with the slot, groove or the like. Alternatively the control means may include spaced formations, which preferably are arcuate, which receive the drawbar between them and which permit limited relative sliding and pivotal movement of the drawbar.

The pivot point, to which the drawbar is secured, is preferably located on buffer means. The buffer means may be engaged directly or indirectly with the axle.

The control means may be movable out of engagement with the drawbar. Preferably the control means is movable to a locking position at which the control means locks the axle in position, at right angles relatively to its direction of movement. In other words in the locking position the control means prevents the axle from pivoting about the pivot point.

Two bogie units of the kind described may be used to make up a bogie system. In one example of the invention the drawbar is continuous and is shared by the respective bogie units. In another example of the invention the respective drawbars of the bogie units are rigidly connectable to each other.

The drawbar may include a buffer mechanism to provide a cushion against shock loading of the drawbar.

It has been pointed out that the invention is applicable to road and rail vehicles. The invention does however find particular application with rail vehicles and consequently the invention is intended to cover a track vehicle which includes at least one bogie unit of the kind described. The track vehicle may include two of the bogie units located respectively at opposed sides of the vehicle.

A tractive unit such as a locomotive may be coupled to a track vehicle of the kind described. This may be accomplished by using two arms which are pivotally connected at first respective ends to the locomotive and at second ends to a connecting device to which the drawbar is fixed.

A train which is made up from a plurality of interconnected track vehicles of the kind described may be terminated by means of a terminating unit, referred to herein as a guard vehicle, the guard vehicle having a single wheeled axle and being directly connected to a respective drawbar of an adjacent track vehicle.

The invention also provides a method of steering at least one wheeled axle which includes the step of permitting the axle to move about a first vertical pivot point while constraining the axle movement by means of a control device which is fixed to the axle and which is movably engaged with a drawbar which is pivotally movable about the second vertical pivot point.

BRIEF DESCRIPTION OF THE DRAWINGS

The invention is further described by way of examples with reference to the accompanying drawings in which.

DESCRIPTION OF PREFERRED EMBODIMENTS

Figure 1:
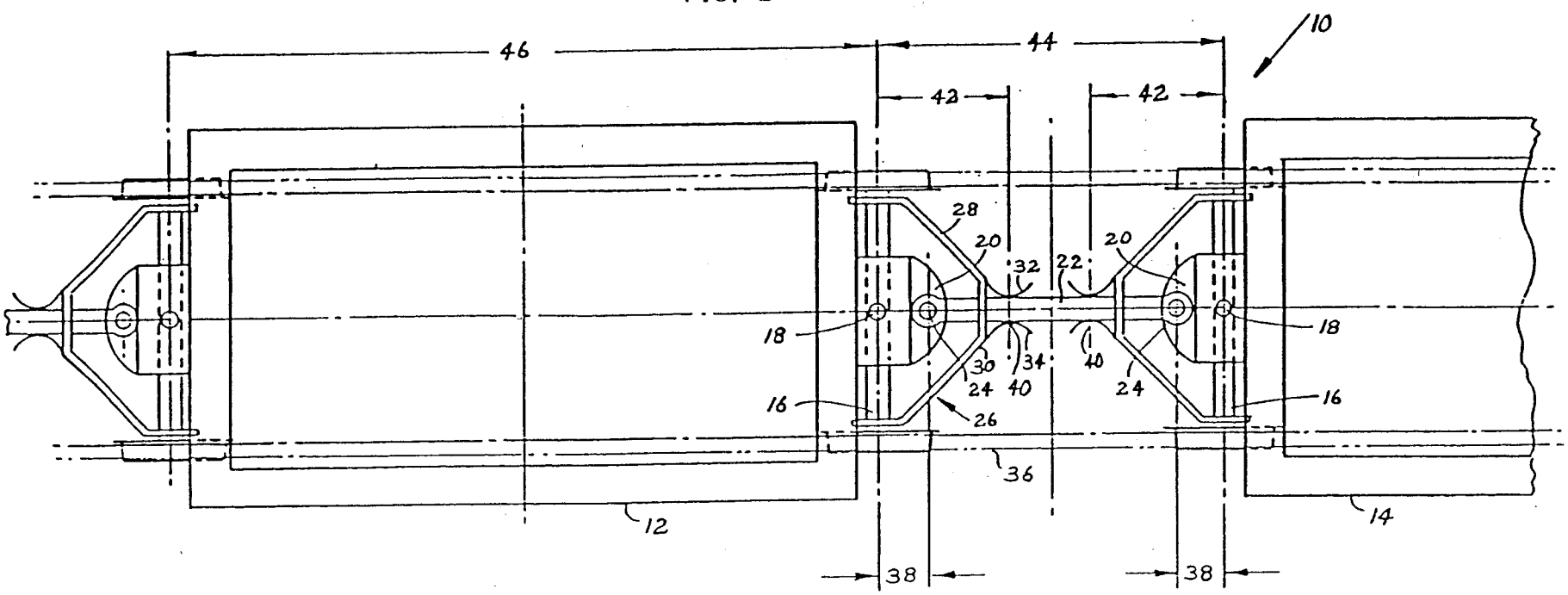
FIG. 1 is a plan view of vehicles which include a bogie steering system according to the invention, on a straight track.

FIGS. 1 to 4 illustrate a bogie system 10 according to the invention. The bogie system interconnects two adjacent vehicles 12 and 14 which may for example be hoppers for use on the mines or the like.

The bogie system 10 includes a first wheeled axle 16 which is mounted for pivotal movement about a vertical axis 18, a buffer arrangement 20 which may be of any suitable type secured directly or indirectly to the axle or the vehicle, a drawbar 22 which is pivotally fixed to the buffer 20 about a vertical axis 24 and a control device 26 which includes first and second control arms 28 and 30 secured to the axle 16 on opposed sides of the pivot point 18 and extending inwardly towards the drawbar 22, the control device 26 including spaced centrally located opposing arcuate members 32 and 34 which receive the drawbar 22 between them.

The equipment described thus far is referred to herein as a bogie unit. It is apparent that the bogie unit associated with the vehicle 12 is duplicated on the vehicle 14 and for this reason the construction of the latter bogie unit is not described. It is to be pointed out however that the drawbar 22 is shared between the vehicles. It is apparent also that similar bogie units are mounted at opposed ends of each vehicle and that a plurality of similar vehicles can be interconnected to make up a train.

Referring to FIG. 1 it can be seen that the vehicles 12 and 14 are on a section of straight track 36. The spacing between the pivot points 18 and 24 is designated 38, the spacing between the pivot point 18 and the contact points 40 of the arcuate members 32 and 34 with the drawbar 22 is designated 42, the spacing between the pivot point 18 of one bogie unit and the pivot point 18 of an adjacent bogie unit is designated 44 while the spacing, on a given vehicle, between the wheeled axles of the vehicle is designated 46.

The exact ratios between the distances 38, 42, 44 and 46 cannot be stated in advance for all vehicle arrangements. In practice it is necessary to adjust the dimensions 38, 42, 44 and 46 relatively to one another in order to obtain the best steering action. However in one example of the invention the ratios were as follows:

38:42:44:46 = 10:42:65:135.

It is stressed that these ratios are given by way of example only and that the ratios will be varied according to requirement under particular operating conditions. However the adjustment of these ratios falls within the scope of one skilled in the art and is easily accomplished through minimal trial and experiment.

Figure 2:
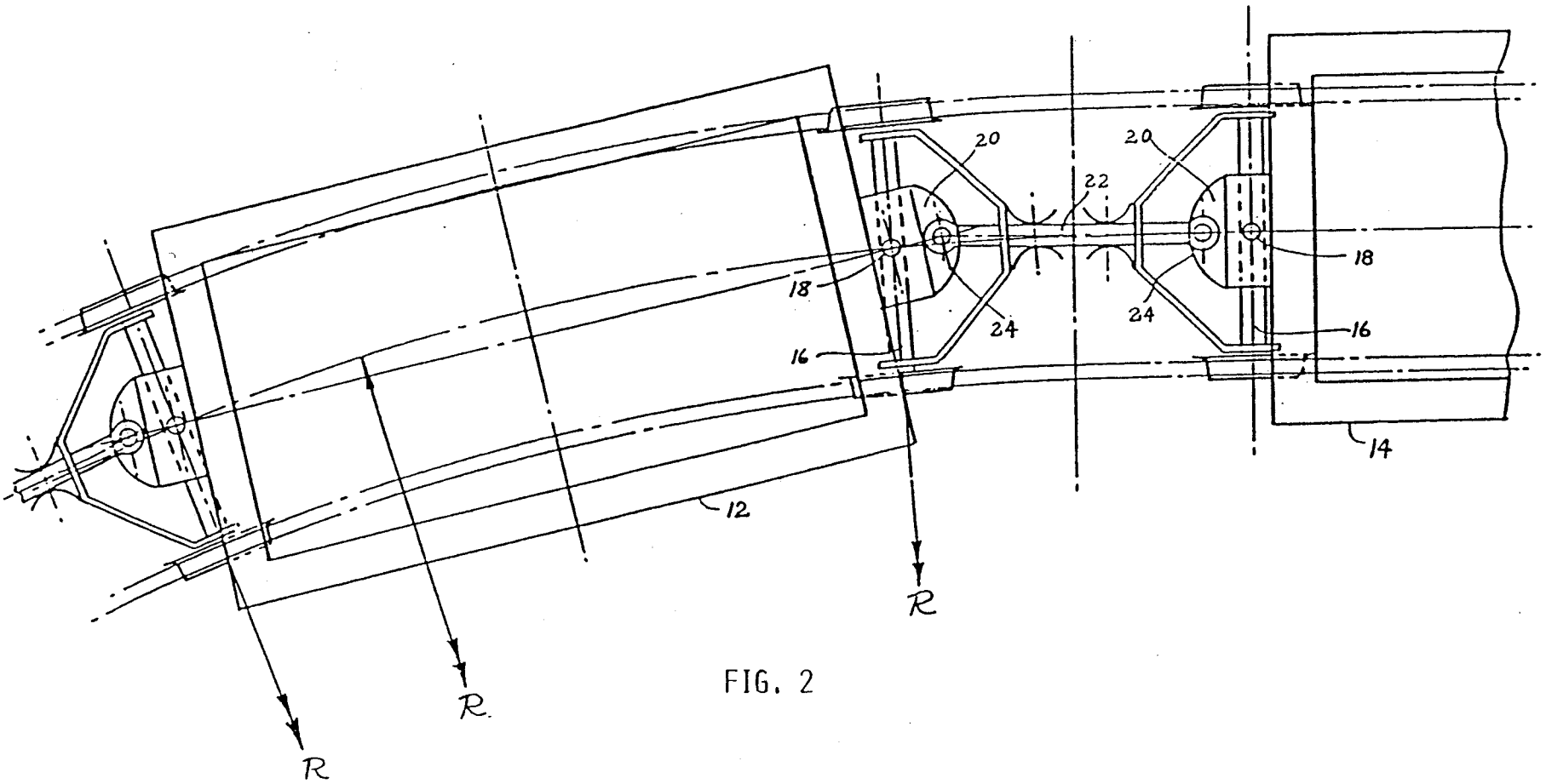
FIG. 2 is a view of the arrangement of FIG. 1 with one vehicle on a curved portion of the track.

When the bogie system 10 of FIG. 1 enters a curve, as is shown in FIG. 2, then the leading axle 16 can pivot about the vertical pivot point 18. The pivot point 24 on the buffer 20 is moved to one side and the drawbar 22 is displaced in the horizontal sense. The axle 16 is constrained by the control device 26 which pivots about the contact points of the arcuate members 32 and 34 on the drawbar 22. It is to be noted that these arcuate members are also slidably movable along the drawbar.

The net result is that the leading axle 16 is maintained correctly aligned on the curved track portion and consequently wear and tear is minimised and rolling resistance is also reduced.

Figure 3:
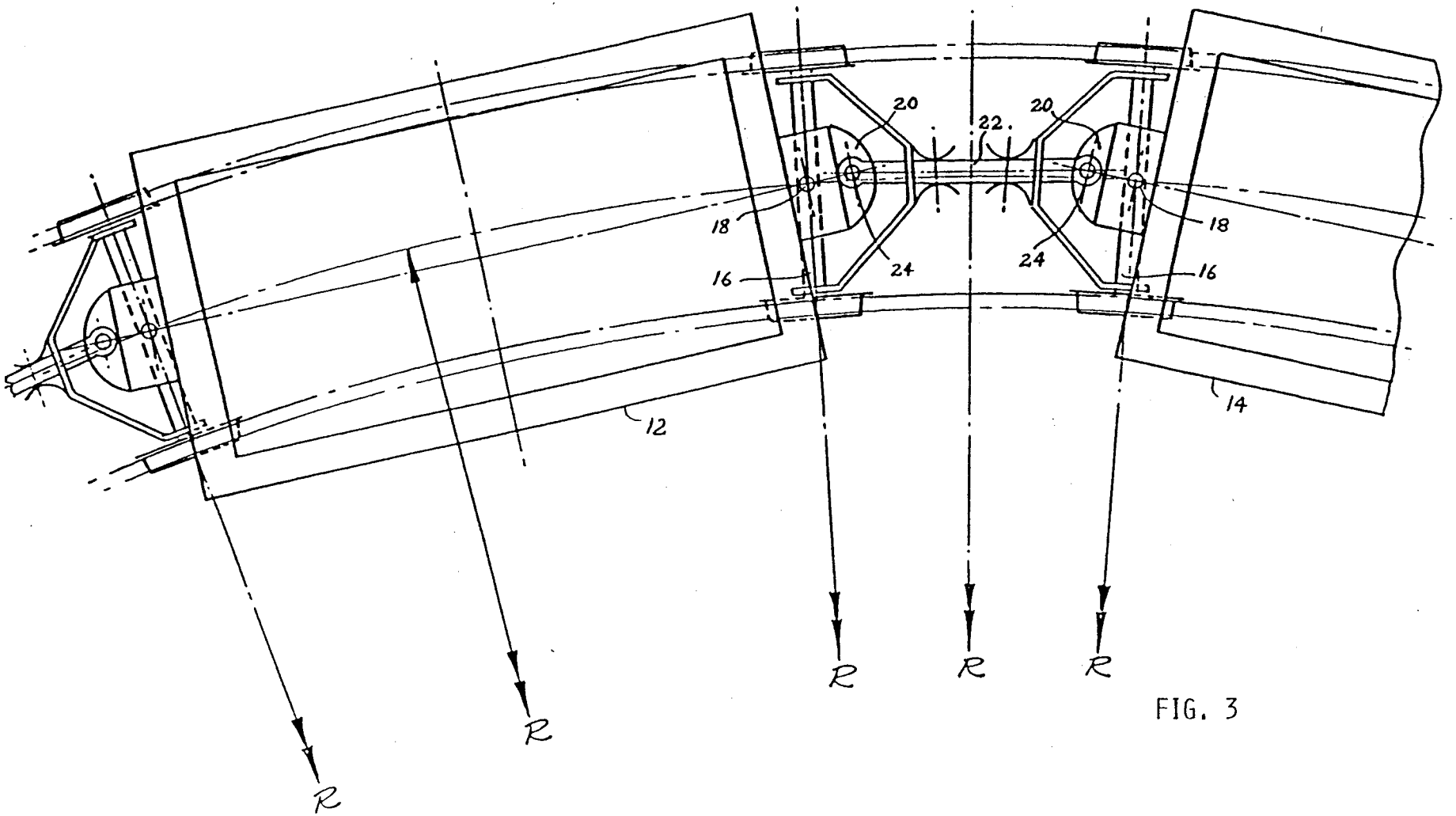
FIG. 3 is a plan view of the arrangement of FIG. 1 with both vehicles on curved track portions.
Figure 4:
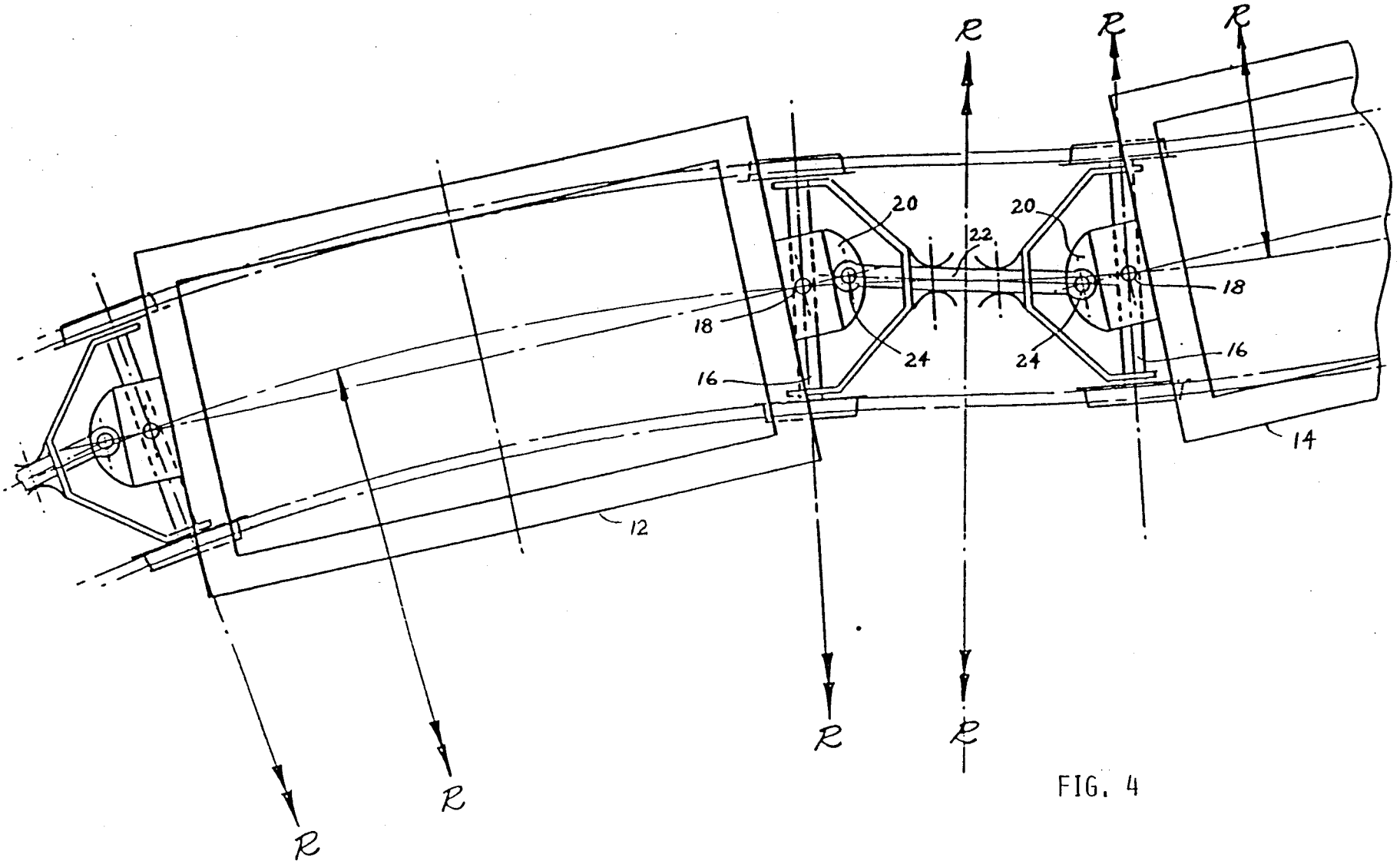
FIG. 4 is a plan view of the arrangement of FIG. 1 with the vehicles on opposed curved portions of an S-bend.

When the trailing axle 16 enters the curve, as is shown is FIG. 3, a similar movement takes place. In other words the steering action of the bogie system enables adjacent axles of adjacent vehicles to be steered correctly into the same curve or, in fact, to be steered correctly as the bogie system negotiates an S-curve as is shown in FIG. 4.

Figure 5:
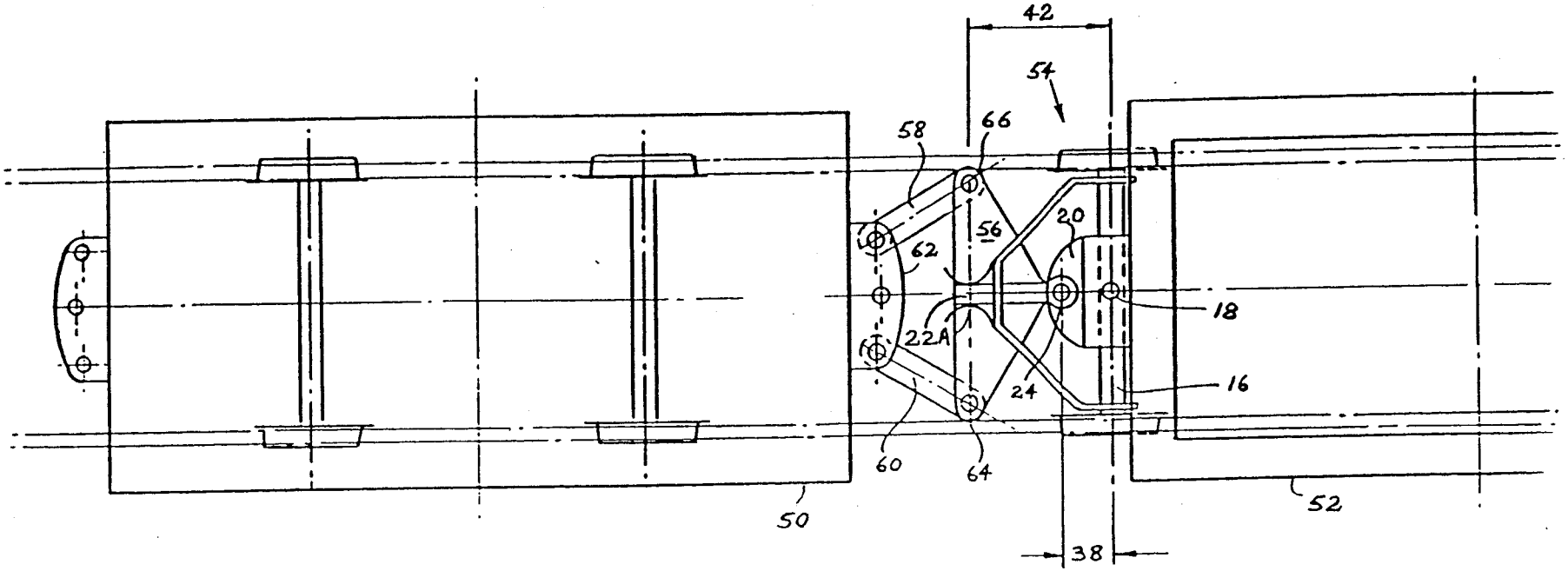
FIG. 5 is a plan view of a locomotive, with non-steering axles, connected to a steered bogie in accordance with the principles of the invention, on a straight track portion.
Figure 6:
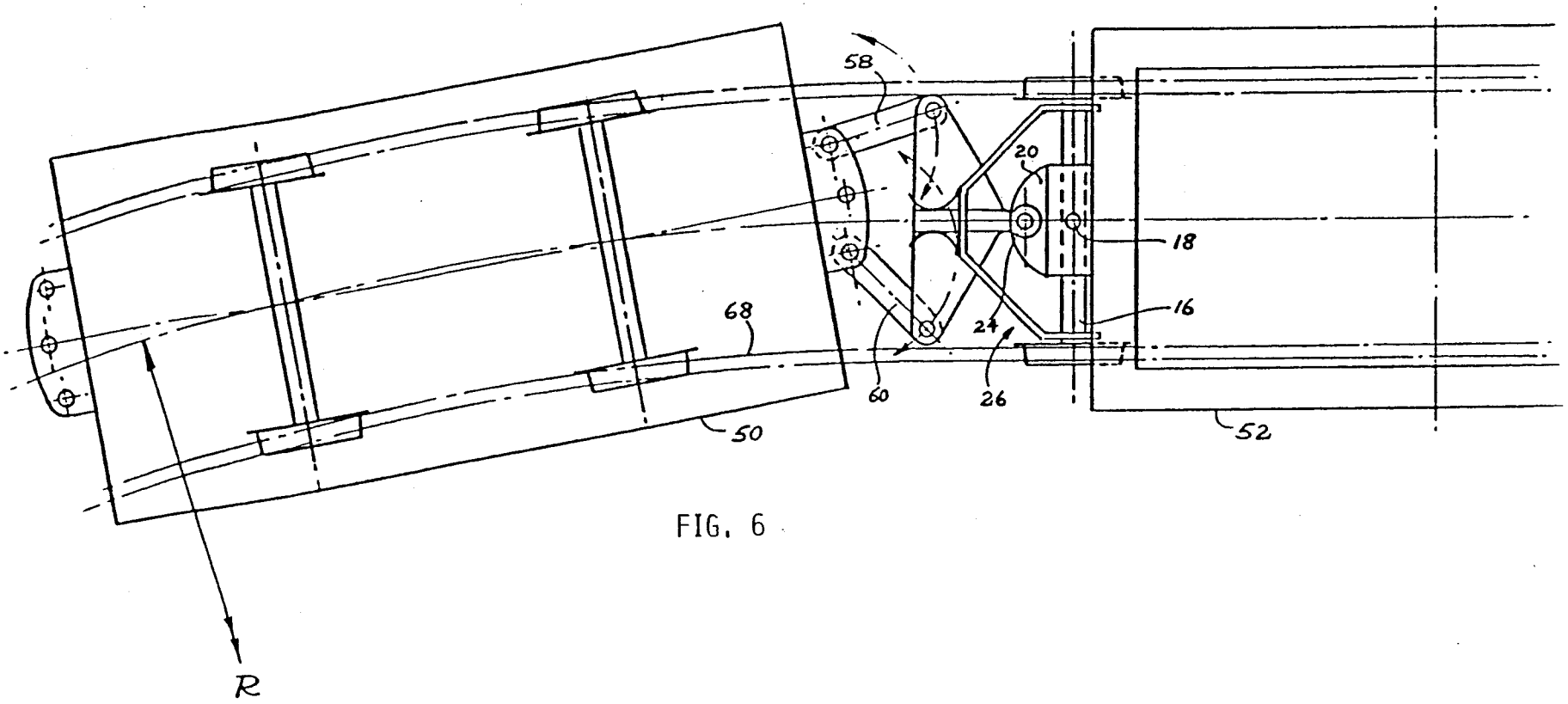
FIG. 6 is a plan view of the arrangement of FIG. 5 with the locomotive on a curve and the adjacent track vehicle on a straight track portion.
Figure 7:
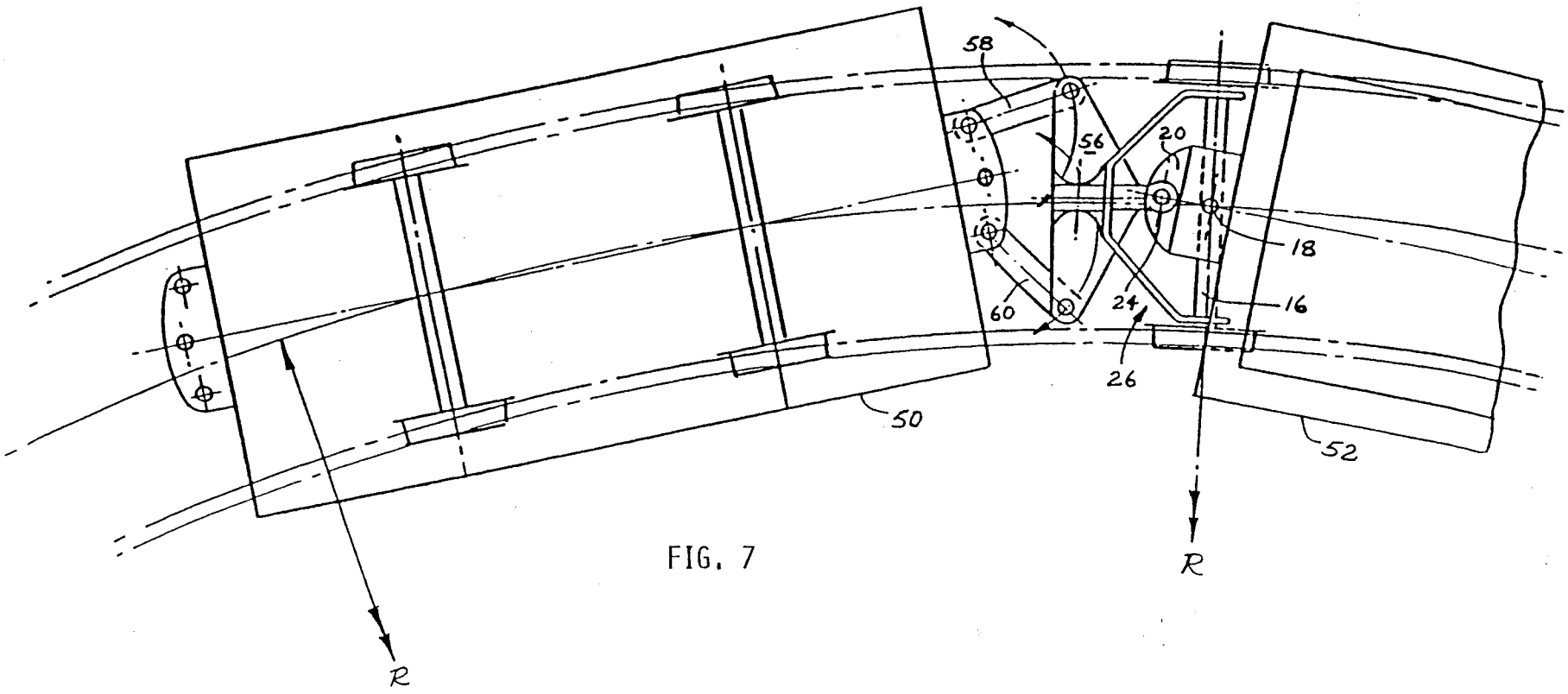
FIG. 7 is a plan view of the arrangement of FIG. 5 with the locomotive and the vehicle on curved track portions.

FIGS. 5 to 7 illustrate a locomotive 50 which draws a train of track vehicles similar to those shown in FIGS. 1 to 4, the leading track vehicle being designated 52 in FIGS. 5 to 7.

The track vehicle 52 has a bogie unit 54 fixed to it. This bogie unit is essentially the same as that described in connection with FIGS. 1 to 4 and consequently is not further elaborated on. The drawbar of the bogie unit is designated 22A and it is to be noted that this drawbar is only half the length of the drawbar shown in FIG. 1.

The drawbar 22A is fixed to a connecting device 56 and connecting arms 58 and 60 are respectively pivotally connected at opposed ends to a buffer 62 on the locomotive and to pivot points 64 and 66 respectively on opposed sides of the connecting device.

FIG. 5 shows the locomotive 50 and the vehicle 52 on a straight track portion. Referring to FIG. 6 it can be seen that the locomotive is on a curved track portion 68 while the vehicle 52 is on a straight track portion. The arms 58 and 60 pivot and slightly alter the orientation of the control device 56. As shown in FIG. 7, as the vehicle 52 enters the curved track portion, the axle 16 of the vehicle 52 is steered with the control device 26 sliding along and pivoting about the drawbar 22A so that the orientation of the axle 16 is correctly maintained on the curved track portion.

Figure 8:
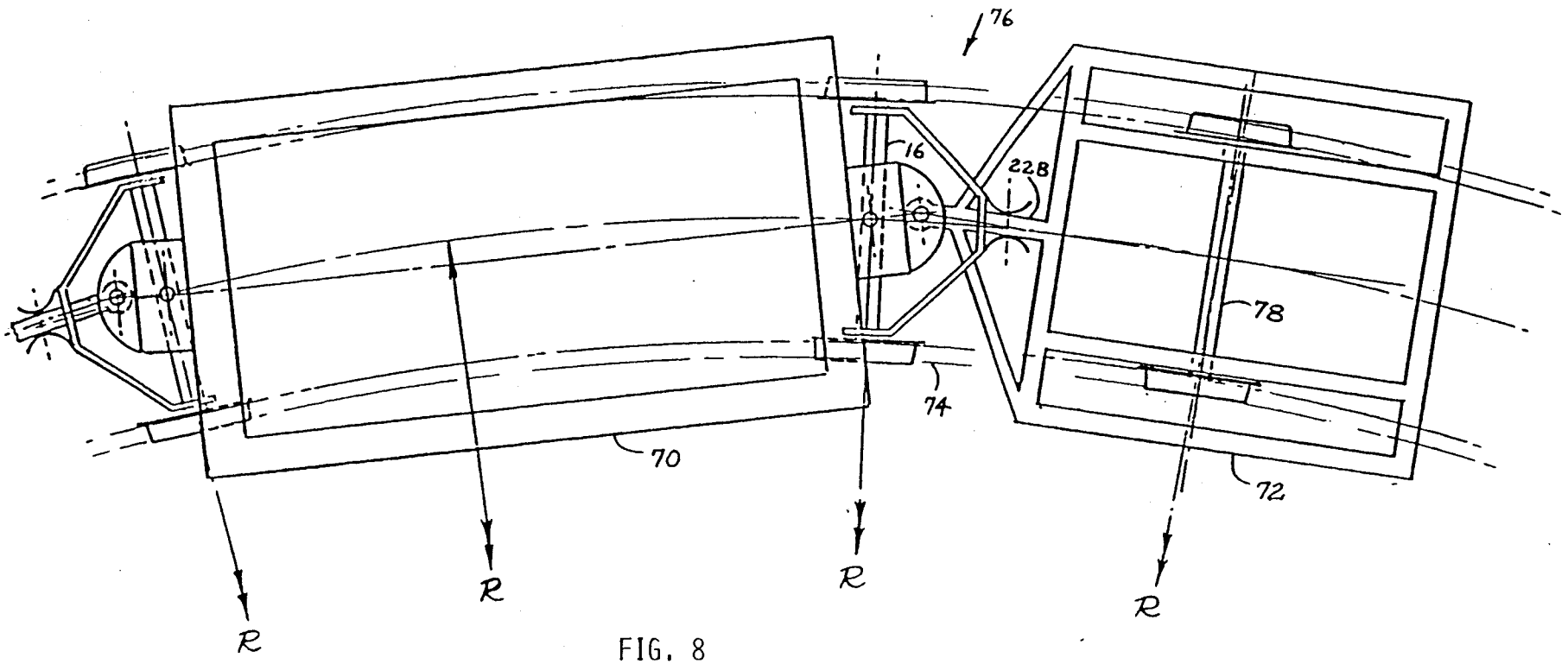
FIG. 8 is a plan view of a terminating or guard vehicle connected to a track vehicle, with both vehicles on curved track portions, FIGS. 9(*a*) and 9(*b*) are plan and side views respectively of a bogie system according to one form of the invention, FIGS. 9(*c*) and 9(*d*) are plan and side views respectively of a bogie system according to a second form of the invention, FIG. 10(*a*) illustrates a variation of the invention with adjacent axles uncoupled, FIG. 10(*b*) illustrates the system of FIG. 10(*a*) with adjacent vehicles coupled to one another.
Figure 9A:
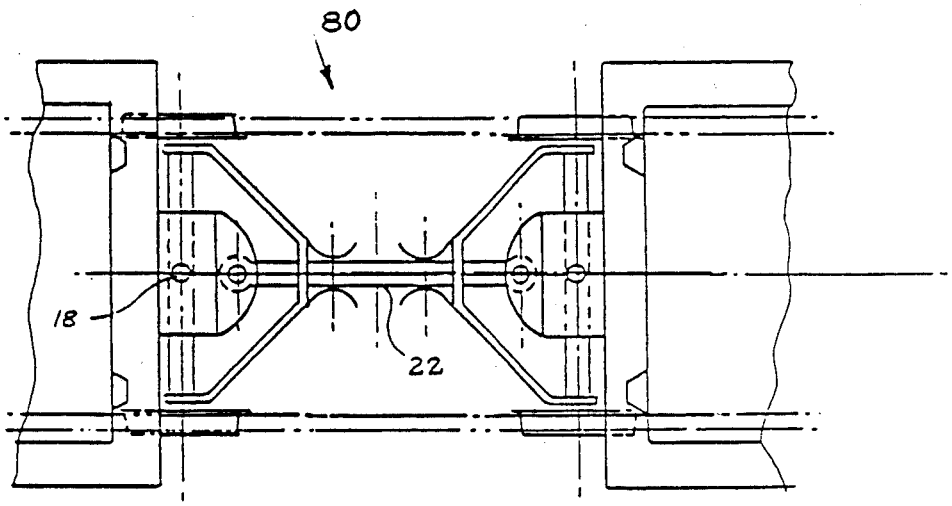
Figure 9B:
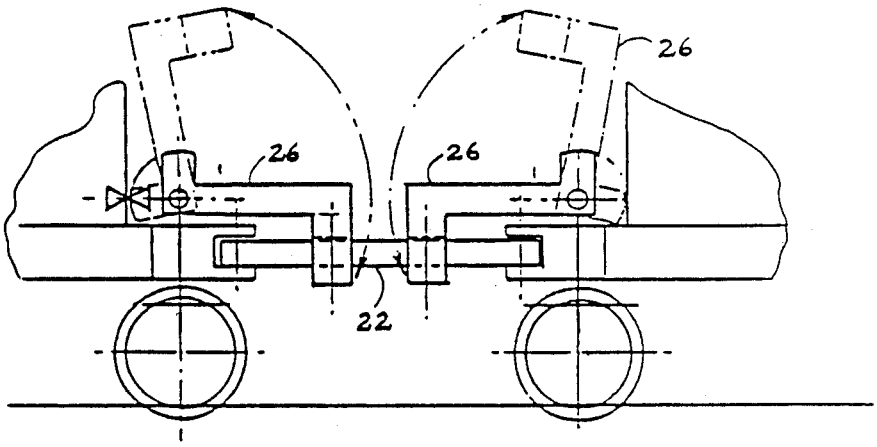
Figure 9C:
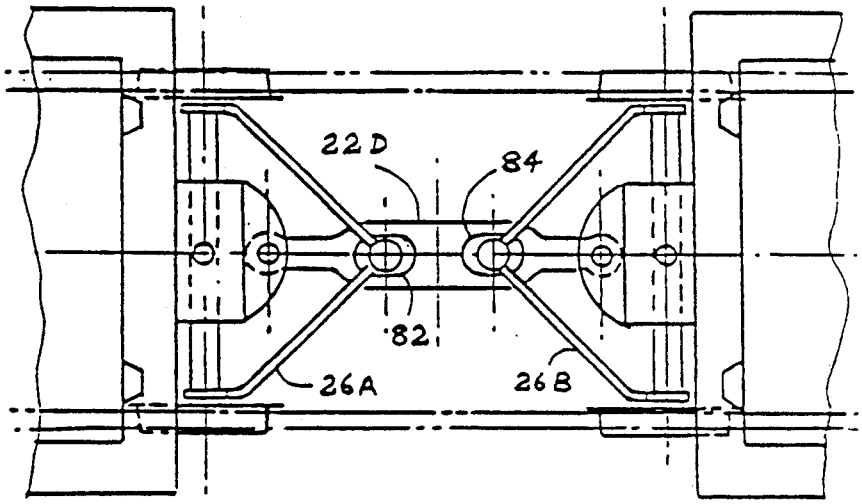
Figure 9D:
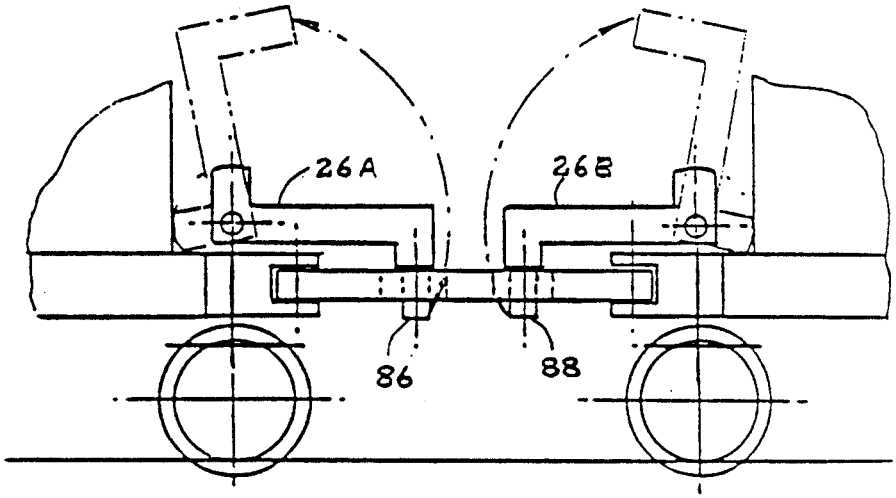

FIG. 8 illustrates in plan a track vehicle 70 and a guard unit 72 on a curved track portion 74. The vehicle 70 has a bogie unit 76 of the kind described while the guard unit 72 has a single wheeled axle 78 and is directly connected to the drawbar 22B of the bogie unit.

The guard unit 72, as it has a single wheeled axle 78, traverses the curved track 74 with the axle 78 correctly aligned at all times. The guard unit 72, as it changes in orientation, causes displacement of the drawbar 22B and this exerts a steering action on the axle 16 of the bogie unit 76.

FIGS. 9(*a*) and 9(*b*) illustrate a bogie unit 80, essentially of the kind described in connection with FIGS. 1 to 8, in plan and from the side respectively. Referring to FIG. 9(*b*) it can be seen that the control devices 26 can be pivoted upwardly, to over centre positions, out of engagement with the drawbar 22. In the upper positions the control devices 26 lock the axles 16 in position by engaging with suitable formations, not shown, on the vehicles on which they are mounted. When the axles are locked in position they cannot pivot about their respective pivot points 80. This feature is used if for any reason a steering action is not required.

FIGS. 9(*c*) and 9(*d*) are similar to FIGS. 9(*a*) and 9(*b*) respectively but show a variation of the invention wherein a drawbar 22D is formed with slots or grooves 82 and 84 respectively. Respective control devices 26A and 26B include projecting formations 86 and 88 respectively which are slidably and pivotally engagable in the slots or grooves 82 and 84 respectively. It is apparent that in all other respects the operation of the bogie system is the same and that the control devices 26A and 26B exert steering actions on the respective axles much in the manner already described.

FIGS. 10(*a*) and 10(*b*) illustrate a drawbar 22E which consists of two sections 22F and 22G respectively. In FIG. 10(*a*) the sections are uncoupled from one another while in FIG. 10(*b*) the sections are shown rigidly connected to each other. Each drawbar section has a slot or groove similar to that described in connection with FIGS. 9(*c*) and 9(*d*).

Figure 11:
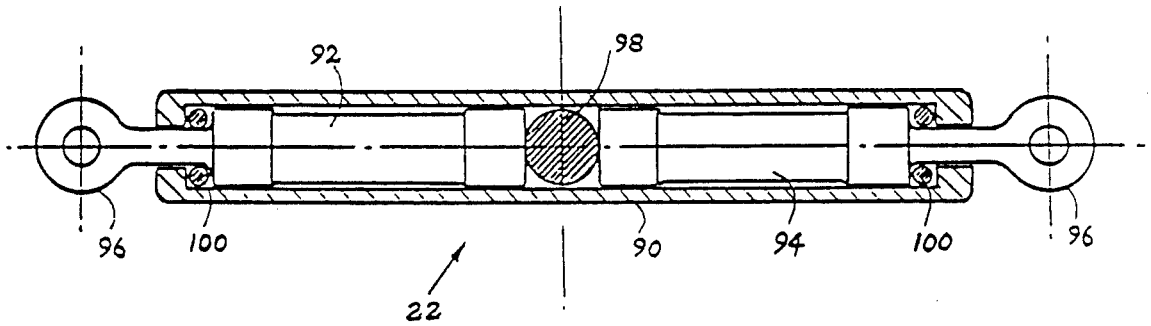
FIG. 11 is a side view in section of a drawbar which includes internal buffer components.

In the arrangements shown in FIGS. 1 to 8 and FIGS. 9(*a*) and 9(*b*) the drawbar 22 of a bogie system is shared by the two bogie units in the system. The drawbar is preferably internally buffered as is shown in the cross-sectional representation of FIG. 11 which depicts a drawbar 22 made up from a tubular member 90 with two internal anchor members 92 and 94 which are slidably located in the member 90. Each anchor member includes a protruding eyelet 96 which enables the drawbar to be coupled to vehicles in the manner described. A resilient cushion 98 is located between opposing surfaces of the anchor members 92 and 94 and resilient rings 100 surround neck portions of the anchor members, adjacent the emerging eyelets. It is apparent that as the drawbar is subjected to compressive loading the centrally located cushion 98 exerts a buffer action while, when the drawbar is subject to tensile loading, the resilient rings 100 also provide a buffer action.

A number of embodiments of the invention have been described. It is apparent that in all cases, whether between a locomotive and a track vehicle, between two similar track vehicles, or between a track vehicle and a guard unit, the invention provides a bogie steering system which causes movable axles to be oriented correctly on a curved track. This minimises wear and rolling friction. It has been found through tests that the benefits gained by the system of the invention are substantial. For example a battery-powered locomotive was able to operate for an additional three hours, without recharging batteries, when the vehicles pulled by the locomotive included bogie steering systems of the kind described.

Figure 12:
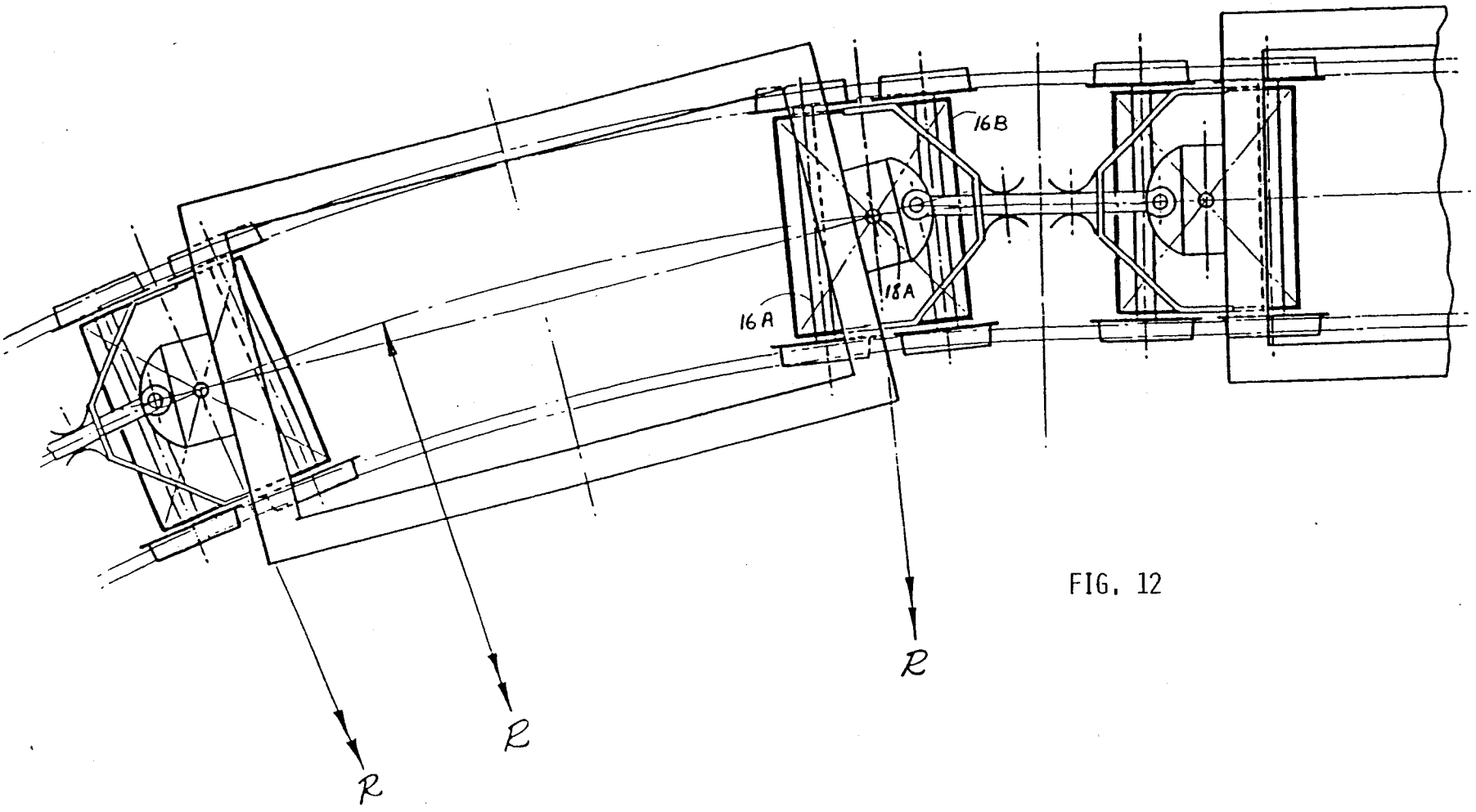
FIG. 12 shows a possible modification to the bogie system.

The bogie unit of the invention has been described with reference to a single axle 16 mounted about the pivot point 18A. If multiple axles are required, due for example to the load which is to be carried by the bogie unit, then two closely spaced parallel axles 16A and 16B can be mounted for pivotal movement, together, about a pivot point 18A as is shown in FIG. 12. As the axles are close together no significant bad side effects result for, effectively, the two axles function and negotiate curves substantially in the same way as one axle without binding of the wheel flanges to the rails.

There is no directional instability with the dual axle system for the steering action of the bogie assembly overcomes this problem. This development makes it possible to use the inventive principles on longer and heavier vehicles which then become capable of negotiating very tight curves.

I claim:

1. A bogie system which includes first and second wheeled axles which are pivotal about respective vertical axes, drawbar means connected at opposed ends to respective pivot points associated with the first and second axles respectively, and control devices which are engaged with each respective axle and the drawbar means and which permit movement of each axle about its respective vertical axis and the respective said pivot point.

2. A bogie unit comprising at least one wheeled axle pivotally movable about a central vertical axis;

a drawbar pivotally secured to a pivot point, said drawbar including a slot; and control means connected to said axle and engaged with said drawbar, said control means being movable, at least to a limited extent, relative to said drawbar, and permitting pivotal movement of said axle, at least to a limited extent, relative to said drawbar, said control means including a formation slidably and pivotally engaged with said slot.

3. A bogie unit comprising at least one wheeled axle pivotally movable about a central vertical axis;

a drawbar pivotally secured to a pivot point; and control means connected to said axle and engaged with said drawbar, said control means being movable, at least to a limited extent, relative to said drawbar, and permitting pivotal movement of said axle, at least to a limited extent, relative to said drawbar, said control means including spaced formations receiving said drawbar between them and permitting limited relative sliding and pivotal movement of said drawbar.

4. A bogie unit comprising at least one wheeled axle pivotally movable about a central vertical axis;

a drawbar pivotally secured to a pivot point; and control means connected to said axle and engaged with said drawbar, said control means being movable, at least to a limited extent, relative to said drawbar, and permitting pivotal movement of said axle, at least to a limited extent, relative to said drawbar, said control means being movable out of engagement with said drawbar to a locking position at which said control means locks said axle in a position at a right angle relative to its direction of movement.

5. A bogie system having first and second opposing bogie units, comprising first and second wheeled axles pivotally movable about central vertical axes of said first and second bogie units respectively;

a continuous drawbar shared by said first and second bogie units, one end of said drawbar being secured to a pivot point of said first bogie unit, and the other end of said drawbar being secured to a pivot point of said second bogie unit; and first and second control means connected to the axles of said first and second bogie units respectively and engaged with said drawbar, said control means being movable, at least to a limited extent, relative to said drawbar, and permitting pivotal movement of said axles, at least to a limited extent, relative to said drawbar.

6. A bogie system having first and second bogie units, each of said bogie units comprising at least one wheeled axle pivotally movable about a central vertical axis;

a drawbar pivotably secured to a pivot point; and control means connected to said axle and engaged with said drawbar, said control means being movable, at least to a limited extent, relative to said drawbar, and permitting pivotal movement of said axle, at least to a limited extent, relative to said drawbar;

the drawbars of each of said first and second bogie units being rigidly connectable to each other.

7. In combination, a locomotive and a track vehicle, comprising at least one bogie unit on each track vehicle including a wheeled axle pivotally movable about a central vertical axis;

a drawbar pivotally secured to a pivot point; and control means connected to said axle and engaged with said drawbar, said control means being movable, at least to a limited extent, relative to said drawbar, and permitting pivotal movement of said axle, at least to a limited extent, relative to said drawbar;

a connecting device, said drawbar being fixed to said connecting device; and two arms pivotally connected at first respective ends to said locomotive and at second respective ends to said connecting device.

8. In combination, a guard vehicle and a track vehicle, comprising at least one bogie unit on said track vehicle, said bogie unit including a wheeled axle pivotally movable about a central vertical axis;

a drawbar pivotally secured to a pivot point; and control means connected to said axle and engaged with said drawbar, said control means being movable, at least to a limited extent, relative to said drawbar, and permitting pivotal movement of said axle, at least to a limited extent, relative to said drawbar; and a single wheeled axle on said guard vehicle, said guard vehicle being directly connected to the drawbar of said track vehicle.

* * * * *